US009327861B2

(12) United States Patent
Haner et al.

(10) Patent No.: US 9,327,861 B2
(45) Date of Patent: May 3, 2016

(54) PLASTIC CONTAINER WITH REINFORCED BASE

(71) Applicant: KRONES AG, Neutraubling (DE)

(72) Inventors: Arno Haner, Wiesent (DE); Gerald Huettner, Vilseck (DE); Thomas Ringl, Ebermannsdorf (DE)

(73) Assignee: KRONES AG (DE)

( * ) Notice: Subject to any disclaimer, the term of this patent is extended or adjusted under 35 U.S.C. 154(b) by 0 days.

(21) Appl. No.: 14/086,579

(22) Filed: Nov. 21, 2013

(65) Prior Publication Data

US 2014/0175043 A1 Jun. 26, 2014

(30) Foreign Application Priority Data

Nov. 27, 2012 (DE) ..... 10 2012 111 493

(51) Int. Cl.
*B65D 90/02* (2006.01)
*B65D 90/12* (2006.01)
*B65D 1/02* (2006.01)

(52) U.S. Cl.
CPC ..... *B65D 1/0261* (2013.01); *B65D 1/0284* (2013.01)

(58) Field of Classification Search
CPC ..... B65D 1/0261; B65D 1/0284; B65D 2501/0036; B65D 2501/0081; B65D 1/44; B29B 2911/14333; B29L 2031/7158
USPC ..... 215/373, 375; D9/516, 520, 552
See application file for complete search history.

(56) References Cited

U.S. PATENT DOCUMENTS

| | | | | |
|---|---|---|---|---|
| 5,908,127 | A | 6/1999 | Weick et al. | 215/373 |
| 8,870,006 | B2 | 10/2014 | Kamineni et al. | 215/382 |
| 8,875,921 | B2 | 11/2014 | Hermel et al. | 215/376 |
| 2004/0211746 | A1 | 10/2004 | Trude | 215/374 |
| 2005/0127024 | A1 | 6/2005 | Darr | 215/382 |
| 2008/0179271 | A1* | 7/2008 | Bangi | 215/40 |
| 2009/0194546 | A1 | 8/2009 | Lane | 220/673 |
| 2010/0072165 | A1* | 3/2010 | Schau | 215/371 |
| 2010/0163515 | A1* | 7/2010 | Nemoto | B65D 1/0223 215/382 |

(Continued)

FOREIGN PATENT DOCUMENTS

| | | | |
|---|---|---|---|
| DE | 602004008161 | 5/2008 | B65D 1/02 |
| DE | 20 2008 012 290 | 12/2008 | B65D 1/02 |

(Continued)

OTHER PUBLICATIONS

German Search Report, related application serial No. 10 2012 111 493.5, dated Aug. 7, 2013 (5 pages).

(Continued)

*Primary Examiner* — Shawn M Braden
(74) *Attorney, Agent, or Firm* — Hayes Soloway P.C.

(57) ABSTRACT

A plastic container has a mouth region and a main body adjoining the mouth region in a longitudinal direction (L) of the plastic container. The main body has a peripheral wall extending around in a circumferential direction of the plastic container. A container base adjoining the main body has a central region and a plurality of reinforcing ribs which, starting from the central region, extend in the direction of the circumferential wall. A stepped portion extending at least partially in the circumferential region of the plastic container is provided in a circumferential region of the container base which extends in the circumferential direction about the longitudinal direction (L), wherein a vertical position of this stepped portion varies in the longitudinal direction (L).

24 Claims, 4 Drawing Sheets

(56) References Cited

U.S. PATENT DOCUMENTS

| | | | | |
|---|---|---|---|---|
| 2011/0303682 | A1* | 12/2011 | Infanti et al. | 220/628 |
| 2013/0087568 | A1* | 4/2013 | Hermel et al. | 220/600 |

FOREIGN PATENT DOCUMENTS

| | | | |
|---|---|---|---|
| DE | 102008047450 | 4/2010 | B65D 1/02 |
| EP | 1 495 979 | 1/2005 | B65D 1/02 |
| EP | 2 163 483 | 3/2010 | B65D 1/02 |
| JP | 2001010624 | 1/2001 | B65D 1/02 |
| WO | WO 2006/067590 | 6/2006 | B65D 1/02 |
| WO | WO 2009/135046 | 11/2009 | B65D 1/02 |
| WO | WO 2011/157952 | 12/2011 | B65D 1/02 |

OTHER PUBLICATIONS

Extended European Search Report issued in corresponding European Patent Appln. No. 13194650.1-1707, dated Jan. 24, 2014 (6 pgs).

* cited by examiner

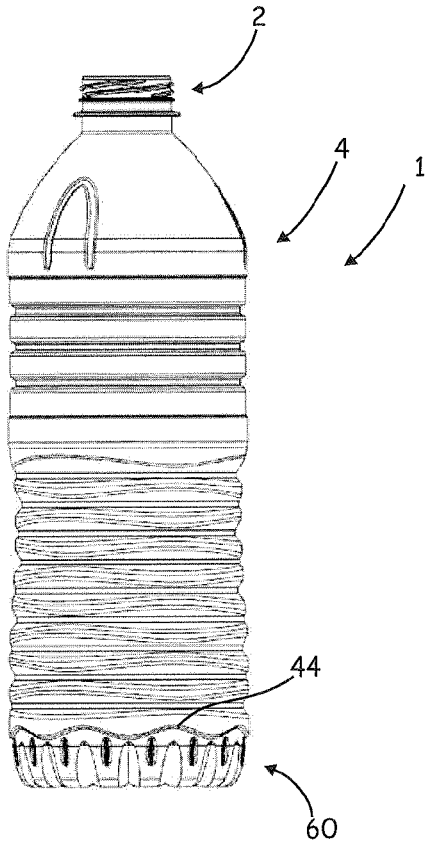
Fig. 2a
Fig. 2b
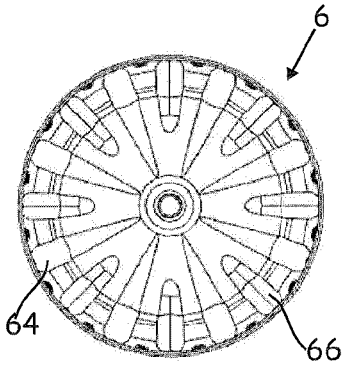
Fig. 2c
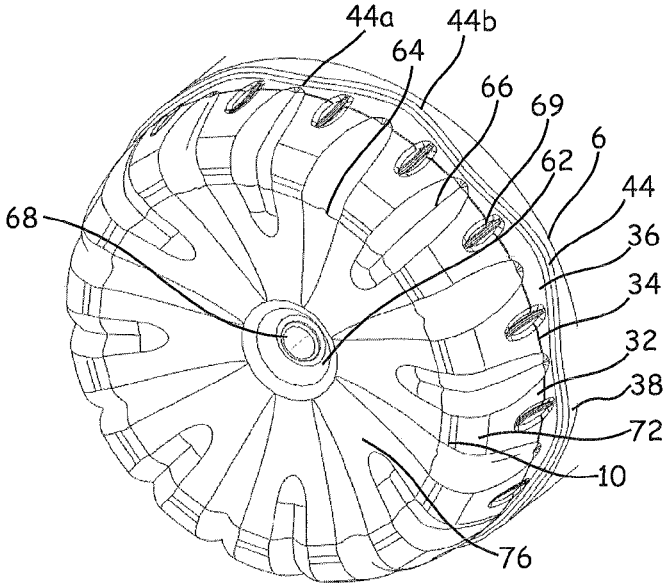

PLASTIC CONTAINER WITH REINFORCED BASE

BACKGROUND OF THE INVENTION

The present invention relates to a plastic container and in particular a plastic bottle. Such plastic containers have been known for a long time from the prior art. When designing such plastic containers and in particular also the bases thereof different criteria should be observed.

Thus on the one hand an attractive design of these bases should be created, but on the other hand they should also exhibit good support stability and moreover in some embodiments should also have a sufficient resilience against the pressure of the liquid located in the container and also generally with respect to pressures exerted in a longitudinal direction of these containers.

Moreover there have been constant attempts recently to reduce the weights of such plastic containers and also to reduce the weights of the corresponding base portions. Therefore container bases which in particular have radially extending reinforcing ribs have already been known for a long time from the prior art.

The object of the present invention is to provide a plastic container which on the one hand has a high stability but in this case functions with a comparatively low base weight. In this case a sufficient stability of the base should be ensured, advantageously even in the case of off-centre loading, for example inside a secondary packaging. In addition such a container should also satisfy the criteria of transportability and stability within a filling line.

In addition the vulnerability in the case of deformations should be reduced, i.e. the container should advantageously remain stable even in the event of small deformations. Finally, it would also be desirable to provide a container which, during manufacturing, can also be fabricated with a final blow moulding pressure which is reduced with respect to the prior art.

SUMMARY OF THE INVENTION

A plastic container according to the invention has a mouth region and also a main body adjoining this mouth region in the longitudinal direction of the plastic container, this main body having a peripheral wall extending around in a circumferential direction of the container. Furthermore the plastic container has a container base adjoining this main body, wherein this container base has a central region and a plurality of ribs which, starting from this central region, extend in the direction of the circumferential wall.

According to the invention, a stepped portion extending at least partially in the circumferential region of the container is provided in a circumferential region of the container base which extends in the circumferential direction about the longitudinal direction of the container, wherein a vertical position of this stepped portion varies in the longitudinal direction of the container.

It is therefore proposed first of all that in the circumferential region of the container base a stepped portion is constructed by which basically the stability of the container is increased. Furthermore, however, this stepped section does not extend in the circumferential direction at a constant height, but its height varies in the circumferential direction. In other words the stepped portion is located at different heights along its course in the circumferential direction of the container. Thus, the stepped portion can have regions which are located closer to the container base than other regions.

Thus, in addition to the actual base surface, which at least in the case of an upright container is also directed downwards, the base portion of the container also has a circumferential surface. In addition the base portion also has a preferably likewise annular transition portion with which the base surface merges into the circumferential region. Said circumferential region advantageously extends at least also in the longitudinal direction of the plastic container and preferably has an angle relative to this longitudinal direction of between 0° and 40°, preferably between 0° and 30°, and preferably between 0° and 20°.

Said stepped portion advantageously extends entirely circumferentially in the circumferential direction of the container and thus particularly preferably forms a closed line.

Said (reinforcing) ribs advantageously extend at least partially in the radial direction and the (reinforcing) ribs preferably extend in each case at least in some portions in a radial direction of the container, i.e. a direction which would intersect a geometric axis of rotation or respectively the longitudinal direction of the container. In the present disclosure both the term "rib" and also "groove" are used. In this case both terms denote the same objects. However, the term "rib" describes the technical function and the term "groove" describes the geometric configuration. In other words the reinforcing ribs are formed as groove-shaped structures.

The reinforcing ribs or respectively grooves advantageously extend in a predetermined direction and this direction preferably runs in a straight line at least when projected in a determined projection direction. In particular, when projected in the longitudinal direction of the container these reinforcing ribs run substantially in a straight line. The reinforcing ribs advantageously extend along their entire extent in a direction which is made up of components of a radial direction of the container and the longitudinal direction.

These ribs are advantageously constructed as reinforcing ribs and in this case for example have curvatures extending into the internal space of the container. The rigidity of the base as a whole can be increased by these reinforcing ribs.

In a further advantageous embodiment the central region is constructed at least in some portions in the form of a dome. Thus, for example a dome-like portion can be provided inside the central region. In this case this dome-like portion can advantageously extend in the direction of the internal space in the container.

In a further advantageous embodiment the container or respectively the base has at least two, preferably at least three different types of reinforcing ribs. These ribs advantageously differ with respect to their length. Thus, for example, a first plurality of main ribs can be provided which are constructed as being and furthermore a second plurality of auxiliary ribs can be provided which are preferably shorter than the main ribs. In this case it is possible that the main ribs and the auxiliary ribs are each disposed alternately in the circumferential direction.

In a further advantageous embodiment the stepped portion is constructed in such a way that a circumference of the container or respectively a cross-section of the container in the region of the stepped portion tapers downwards, i.e. in the direction of the base.

The stepped portion advantageously has at least in portions a curved configuration relative to the longitudinal direction of the plastic container (or respectively in a projection perpendicular to the longitudinal direction). This means that if the configuration is followed in the circumferential direction of the container it is curved at least in some portions. Thus, the height of this stepped portion preferably changes, not in steps but continuously.

Furthermore the stepped configuration runs in an undulating or respectively sinusoidal manner relative to the longitudinal direction of the plastic container. Due to this embodiment of the base with the curved stepped portion and the design of the reinforcing ribs, the new base has an improved stability against pressure from above onto the container as well as against the action of force from below, for example through the closure of a bottle (e.g. during stacking). The force is optimally distributed precisely by this curved step or respectively the curved stepped portion and also the stiffening ribs which end at the different positions. The extensions of the reinforcing ribs do not form any horizontal tension peaks or respectively possible kink points.

The different groove configuration of short and relatively long reinforcing ribs results in bracing of the side wall so that, in combination with the curved stepped portion an improved distribution of force can be achieved in the longitudinal direction and thus the base is more stable than in containers from the prior art. This can also be achieved in particular for low container weights. This stepped portion advantageously has a surface which extends in a radial direction and in a circumferential direction (and thus in particular is annular) and which is directed downwards.

Depending upon the number of grooves or respectively the number of reinforcing ribs, this curved stepped portion may also have a different number of undulation high points and low points. Advantageously, however, at least two undulation high points and two undulation low points are distributed about the circumference of the container. These high points and low points advantageously alternate between the extensions of the reinforcing ribs in the respective flank faces of the containers. In this case the peak-trough value of the curved stepped portion is between 2% and 40% of a height of the floor, preferably between 5% and 30% and particularly preferably between 10% and 25%.

The height of the base is thereby also determined in particular by the height of a corresponding base part which forms the base region thereof during a process of blow moulding of the plastic container.

The stepped portion advantageously has a difference in diameter (between the main diameter and the flank faces) which is dependent on the main diameter. In this case the stepped portion connects the bottle body or respectively the main body to the base. The difference in diameter is preferably between 0.5 mm and 2 mm, particularly preferably between 0.6 mm and 1.5 mm and particularly preferred between 0.75 mm and 1.25 mm.

Also in the event of different main diameters of the container the aforementioned dome-shaped portion in the central region can have different radii of curvature. A dome which is curved concavely into the interior of the container is advantageously provided in a further region of the base portion which extends in particular about the injection point. Thus, for example, a main dome can be provided which extends from a circumferential edge of the container in the central region and a second dome, in particular with a greature curvature, can be provided within the central region. Also a radius of this "small dome", which is provided in the region of the base, may have a radius which is chosen as a function of a main diameter and a base height.

In a further advantageous embodiment at least one rib extends in the above-mentioned circumferential region of the container base. Thus, at least one rib advantageously extends in the longitudinal direction of the container or at an angle relative to the longitudinal direction of the container which is less than 40°, preferably less than 30°, preferably less than 20° and preferably less than 10°.

However, preferably at least one rib and particularly preferably all ribs are spaced from the stepped portion. Thus, the respective reinforcing ribs end before the stepped portion. Particularly preferably the respective reinforcing ribs always end directly below the stepped portion, so that the reinforcing ribs are always constructed as far as the stepped portion, but never cross it.

In a further preferred embodiment at least two reinforcing ribs end at different heights on the container relative to the longitudinal direction thereof. Preferably in this case the reinforcing ribs of a first group of reinforcing ribs end at a first height on the container and the reinforcing ribs of a second group of reinforcing ribs end at a second height, different from the first. However, it would also be conceivable for the ribs to end at the same height.

The plastic container is preferably, a blow moulded container and in particular a stretch blow moulded plastic container. This plastic container is preferably produced from PET.

In a further advantageous embodiment at least one reinforcing rib intersects the central region or respectively touches it or protrudes into it. In a further advantageous embodiment the transition region of the base portion has a wall region which extends in the circumferential direction of the container and is curved in the longitudinal direction. Particularly preferably in addition to this first wall region extending in the circumferential direction a second wall region is provided which extends in the circumferential direction and is particularly preferably likewise curved. In this embodiment, therefore, the flank of the base has, in particular below the stepped portion, at least two surfaces which particularly preferably are rounded and particularly preferably do not extend tangentially.

In a further advantageous embodiment the plastic container has an annular base surface. This annular base surface is advantageously constructed in the base region and is particularly preferably interrupted only by the reinforcing ribs or respectively a part of these reinforcing ribs.

Thus in a further embodiment the base portion has a support surface, wherein preferably a support circle diameter is chosen as a function of a main diameter of the container. Thereby, this support circle diameter is advantageously between 65 and 85% of the main diameter of the container and preferably between 70% and 80% of this main diameter.

Advantageously at least two reinforcing ribs, which can already end before the stepped portion, have different groove cross-section geometries relative to one another. In this case in particular the groove radii of these two groove cross-sections differ from one another. These groove radii are advantageously between 0.5 mm and 2 mm, particularly preferably between 0.6 mm and 1.5 mm and particularly preferably between 0.75 mm and 1.25 mm.

In a further advantageous embodiment the height of a groove outlet, in particular in the flank faces, can also be different from stiffening groove to stiffening groove.

As mentioned, longer ribs or respectively main ribs intersect the above-mentioned dome-shaped portion and extend as far as this dome-shaped portion into the central region of the base.

Furthermore the present invention is directed to a container base for a plastic container. This container base thereby has a central region in which in particular an injection point is also disposed. In addition the container base also has a plurality of—in particular groove-like—reinforcing ribs which extend in a radial direction of the container base. According to the invention, a stepped portion extending at least partially in the circumferential region of the container is provided in a circumferential region of the container base which extends in the circumferential direction about the longitudinal direction of the container, wherein a vertical position of this stepped portion varies in the longitudinal direction of the container.

Therefore with regard to the container base which can in particular be combined with any containers it is proposed that the said stepped portion does not extend at a constant height (relative to a direction perpendicular the base and corresponding to a longitudinal direction of the container). The container base preferably configured in the manner set out above. The container base preferably has a substantially circular cross-section. In principle, however, it would also be conceivable for the stepped portion according to the invention to be used also in containers with other conventional cross-sections (for example rectangular cross-sections, square cross-sections, cross-sections with rounded corners, oval cross-sections and the like).

Furthermore the present invention is directed to the use of a container of the type described above and/or a container base of the type described above for filling a still beverage (i.e. a beverage which is in particular free of or low in carbon dioxide) and in particular a still water.

Further advantages and embodiments are apparent from the appended drawings.

BRIEF DESCRIPTION OF THE DRAWINGS

In the drawings:

FIGS. 2*a* to 2*e* show a container according to the invention in a second embodiment.

DETAILED DESCRIPTION OF THE INVENTION

Figure 1A:
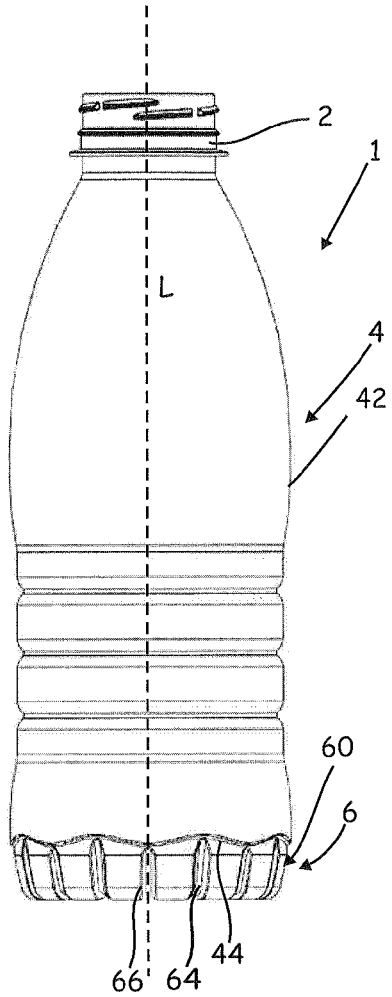
FIGS. 1*a* to 1*d* show a container according to the invention in a first embodiment.

FIGS. 1*a* to 1*d* show a container 1 according to the invention in a first embodiment. In this case FIG. 1*a* shows a side view of such a container 1. This container has a mouth region 2 with a thread onto which a closure can be screwed. This mouth region 2 is adjoined by a main body 4 of the container which substantially surrounds the inner volume of the container 1.

This main body 4 in turn adjoins a base region or respectively the container base 6, which should be described definitively here within the context of the invention. This container base 6 has a stepped portion 44 which, as can be seen in FIG. 1*a*, has an undulating form having highpoints and low point points. In this case this container base has reinforcing ribs 64 and 66 which are, however, constructed with different lengths designed.

It will be recognised that these reinforcing ribs also extend into a circumferential region 60 of the container base 6, but do not touch or intersect the stepped portion 44. The reference sign 42 identifies a circumferential wall of the main body which substantially encloses the volume of liquid which is held or respectively can be received by the plastic container.

Figure 1B:
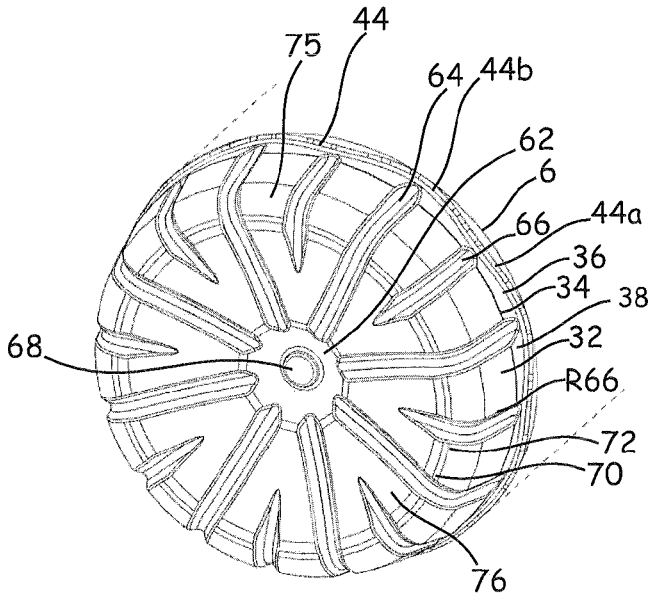

FIG. 1*b* shows an oblique view of a container base 6. This again has the two reinforcing ribs 64 and 66. The reference sign 62 identifies a central region of the container base 6, in the centre of which the injection point 68 is disposed. It will be recognised that the relatively long reinforcing ribs 64 extend as far as this central region 62, but the short reinforcing ribs 66 preferably end before the central region 62, although in principle it would also be conceivable for the reinforcing ribs 66 also to extend into the central region 62. The central region here has a circular cross-section. The radius of this central region is preferably between 1/7 and 6/7 of the radius of the base portion, preferably between 1/6 and 5/6 of the radius of the base portion, preferably between 1/5 and 4/5 of the radius of the base portion, preferably between 1/5 and 3/5 of the radius of the base portion.

The reference sign 76 likewise identifies the base region, inside which the reinforcing ribs 66 and 64 at least partially formed. This base region 76 extends from the central region 62 to the actual base surface 70.

In this case this base region 76 is also curved inwards like a dome. However, a corresponding radius of curvature of the central region 62 is smaller than a radius of curvature of the base region 76. Thus in this case this base region 76 is also annular in cross-section. The reference sign R66 identifies a radius of curvature of the short reinforcing ribs 66.

The reference sign 72 identifies a support ring or respectively an outer support circle on which the container can stand. This support circle is adjoined by a circular, curved surface 75 and then again in the direction of the main body of the container 2 by flanks 32 and 36 which are delimited from one another by a rounded portion 34 extending between them. These two flank surfaces are curved with respect to the longitudinal direction L of the containers 1.

In this case the stepped portion 44 has, as mentioned above, an undulating structure and thus undulation high points 44*a* and undulation low points 44*b*. In this case an undulation high point is understood to be the region which is disposed nearer to the base or respectively to the reinforcing ribs and an undulation low point is understood to be the portion which is further away from these reinforcing ribs 64, 66. The reference sign 38 designates a base flank by which the container base 6 transitions via the stepped portion 44 into the main body 4.

Figure 1C:
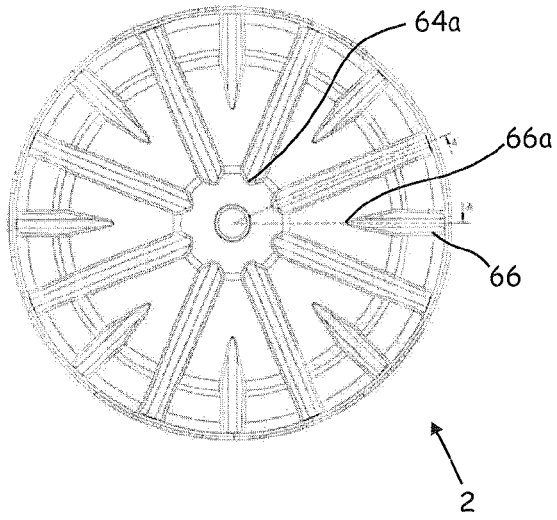

FIG. 1*c* shows again a plan view of the container base 6. It shows the end regions 66*a* of the short reinforcing ribs 66 and the end regions 64*a* of the longer reinforcing ribs, which each taper radially inwards.

In this embodiment the reinforcing ribs 64 and 66, which in each case end before the stepped portion 44, can have a different groove cross-section geometry with respect to one another. The groove radii of the two groove cross-sections may also be different. However, the geometry of the individual reinforcing ribs preferably does not change in its configuration, but it may change as a function of the groove depth and the main diameter X (of the container base as a whole).

Figure 1D:
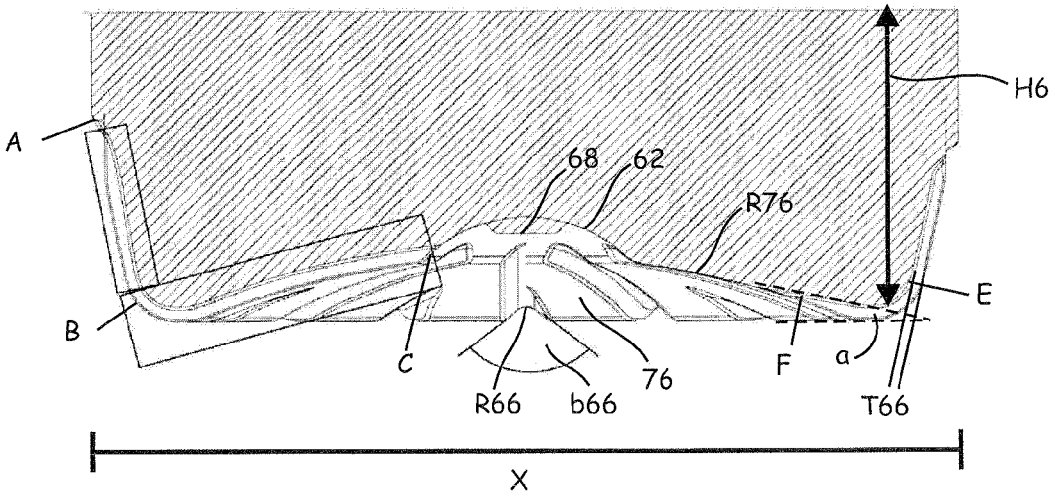

It can also be seen in FIG. 1*d* that a groove contour of the respective shorter reinforcing ribs 66 also follows the basic contour of the container base 6 in the region of the flank faces 32, 36, i.e. the region below the stepped portion 44. Furthermore these small reinforcing ribs 66 intersect the base region 76 or respectively the large dome in the illustrated region E-F at a predetermined angle a which is a function of the main diameter X and by the base height H6. This angle a is preferably between 5° and 15, preferably between 8° and 12°. In this case this angle a is also a function of the radius of curvature of the transition region R76. The reference sign T66 in FIG. 1*d* identifies a groove depth of the reinforcing rib 66.

The groove contour of the long reinforcing rib 64 does not follow the basic contour of the base shape in the region A-B. In the area B-C the groove contour follows the basic contour parallel as far as the central region 62. The distance of the groove contour from the basic contour may vary as a function of the base height and the main diameter X, as mentioned above in greater detail and is preferably between 0.75 mm and 1.5 mm. In this case the groove depth may be different in the case of the longer and shorter reinforcing ribs or stiffening ribs 64, 66.

The groove geometry of the individual reinforcing ribs, that is to say in particular the angle b66 and R66, preferably remains constant over the entire extent. However, this geometry may change as a function of the groove depth and of the main diameter of the container base 6. The groove aperture angle b66 of the reinforcing ribs may have different values. This angle is preferably in a range between 55° and 120° and particularly preferably between 70° and 115°.

Figure 2D:
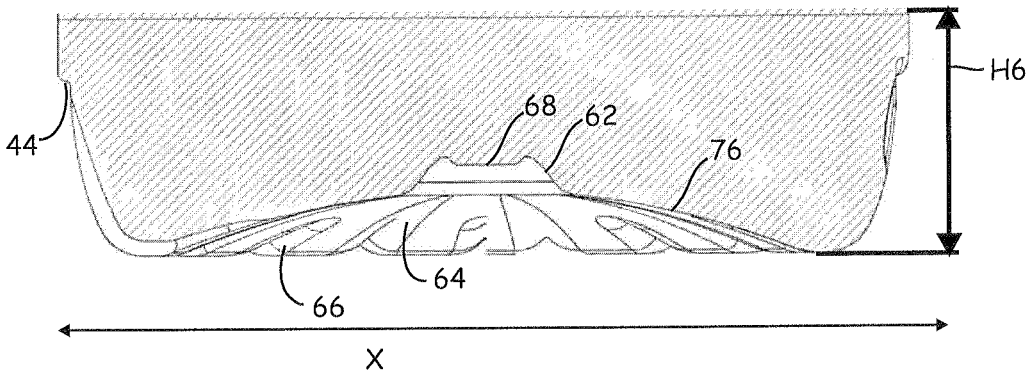
Figure 2E:
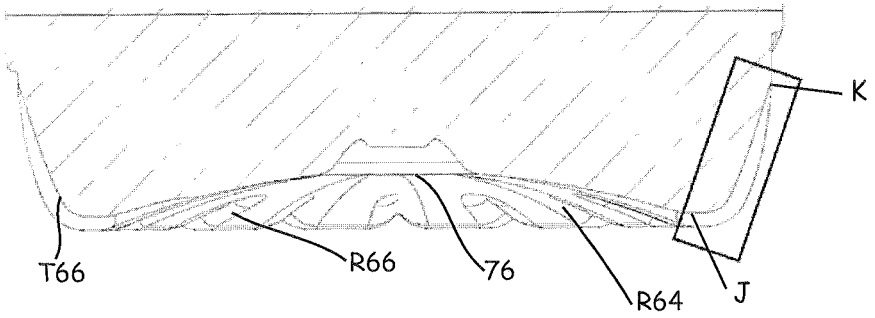

FIGS. 2*a* to 2*e* show further embodiments of a container 1 according to the invention. In this case in FIG. 2*a* in turn the container 1 is shown in a side view, FIG. 2*b* shows a plan view of the container base 6 in which the reinforcing ribs 64 and 66 can be seen, and FIG. 2*c* in turn shows an oblique view of the container base 6. Some features of this container base 6 correspond to the container base shown in FIG. 1*b* and therefore are not explained in greater detail.

However, in contrast to the container base 6 shown in FIG. 1*b* the long reinforcing ribs 64 only extend as far as the edge of the central region 62. Also the reinforcing ribs 64 do not have a constant profile here, but the profile changes. In addition the base shown in FIG. 2*c* has a plurality of lateral stiffening ribs 69 which are disposed on the lateral flank of the container base 6. However, these lateral stiffening ribs 69 do not intersect the stepped portion 44.

In this embodiment the reinforcing ribs 64 and 66, which in each case end before the stepped portion 44, can have a different groove cross-section geometry with respect to one another. Here too reinforcing ribs can extend beyond the rounded portion of the flank face, but does not intersect the stepped portion not intersect. The groove diameter of these reinforcing ribs may be different. The groove contours of these reinforcing ribs follow the basic contour of the base in its total course. The reference sign R64 in FIG. 2*e* identifies a radius of curvature of the reinforcing ribs 64.

As illustrated here, the main reinforcing ribs 64 again run tangentially in the base surface, but can also already terminate before the large dome-like structure 76. They preferably have a radius which is constant in a range J-K and is preferably between 0.2 and 1.5 mm. The intermediate ribs 66 here preferably also terminate tangentially in the base surface and end inside the base surface, as shown. Advantageously these lateral reinforcing ribs or respectively auxiliary ribs end in a ratio with respect to the main diameter X in a range between 25% and 75% and preferably between 30 and 70% and particularly preferably between 40 and 60%. A particularly favourable stiffening of the container base 6 can be achieved by this choice of the respective lengths.

With the new base design shown in the drawings considerable improvements relative to the prior art are achieved. A particular achievement is that the container base 6 is still very stable even with a minimum weight.

The applicant reserves the right to claim all the features disclosed in the application documents as being essential to the invention in so far as they are individually or in combination novel over the prior art.

LIST OF REFERENCE SIGNS

1 container
2 mouth region
4 main body
6 container base
32/36 flank faces
34 rounded portion
38 base flank
42 circumferential wall
44 stepped portion
44*a* undulation high points
44*b* undulation low points
60 circumferential region of the container base
62 central region of the container base
64 long reinforcing ribs
64 short reinforcing ribs
66*a* end region the reinforcing ribs 66
68 injection point
69 lateral reinforcing rib
70 base surface
72 outer support circle
75 circular, curved surface
76 base region
E-F illustrated range
A angle
X main diameter
H6 base height
B-C region
R64/R66 radius of curvature
b66 groove aperture angle
T66 groove depth

The invention claimed is:

1. A plastic container having a mouth region, a main body adjoining the mouth region in a longitudinal direction (L) of the plastic container, the main body having a circumferential wall extending around in a circumferential direction of the plastic container, and a container base adjoining the main body, wherein the container base has a central region and a plurality of reinforcing ribs which, starting from the central region, extend in the direction of the circumferential wall, wherein a stepped portion extending at least partially in a circumferential region of the plastic container is provided in a circumferential region of the container base which extends in the circumferential direction about the longitudinal direction (L), wherein a vertical position of this stepped portion varies in the longitudinal direction (L), and the stepped portion has regions of reducing diameter portions measured in a direction from the main body to the container base, and wherein the container base has a support ring or an outer support circle on which the container can stand, wherein the support circle or outer support circle is adjoined by circular, curved surfaces extending in the direction of the main body of the container by flanks which are delimited from one another by rounded portions of the curved surfaces extending therebetween.

2. The plastic container as claimed in claim 1, wherein the stepped portion has at least in portions a curved configuration relative to the longitudinal direction (L) of the plastic container.

3. The plastic container as claimed in claim 2, wherein the stepped portion has an undulating configuration relative to the longitudinal direction (L) of the plastic container.

4. The plastic container as claimed in claim 1, wherein at least one of the plurality of reinforcing ribs extends in the circumferential region of the container base.

5. The plastic container as claimed in claim 1, wherein each reinforcing rib is spaced from the stepped portion.

6. The plastic container as claimed in claim 1, wherein at least two of the plurality of reinforcing ribs end at different heights of the container relative to the longitudinal direction (L) thereof.

7. The plastic container as claimed in claim 1, wherein at least one of the plurality of reinforcing ribs intersects the central region.

8. The plastic container as claimed in claim 1, wherein the central region has a dome structure at least in portions.

9. The plastic container as claimed in claim 1, wherein the circumferential region has a first wall region which extends in the circumferential direction and is curved in the longitudinal direction (L).

10. The plastic container as claimed in claim 1, wherein the plastic container has an annular support surface.

11. The plastic container as claimed in claim 1, wherein the stepped portion is constructed such that a circumference of the container or respectively a cross-section of the container in the region of the stepped portion tapers downwards, in the direction of the base.

12. The plastic container as claimed in claim 1, wherein the base has an annular transition portion with which a surface of the base merges into the circumferential region, said circumferential region extends at least also in the longitudinal direction of the plastic container and has an angle relative to the longitudinal direction of between 0° and 40°.

13. The plastic container as claimed in claim 12, wherein the circumferential region extends in an angle relative to the longitudinal direction of between 0° and 30°.

14. The plastic container as claimed in claim 12, wherein the circumferential region extends in an angle relative to the longitudinal direction of between 0° and 20°.

15. The plastic container as claimed in claim 1, wherein the stepped portion is different in diameter, from a diameter of the main body, and wherein the stepped portion connects the main body to the base.

16. The plastic container as claimed in claim 15, wherein the difference in diameter is between 0.5 mm and 2 mm.

17. The plastic container as claimed in claim 15, wherein the difference in diameter is between 0.6 mm and 1.5 mm.

18. The plastic container as claimed in claim 15, wherein the difference in diameter is between 0.75 mm and 1.25 mm.

19. The plastic container as claimed in claim 1, wherein the central region has a radius between 1/7 and 6/7 the radius of the container base.

20. The plastic container as claimed in claim 1, wherein the central region has a radius between 1/6 and 5/6 the radius of the container base.

21. The plastic container as claimed in claim 1, wherein the central region has a radius between 1/5 and 4/5 the radius of the container base.

22. The plastic container as claimed in claim 1, wherein the central region has a radius between 1/4 and 3/4 the radius of the container base.

23. The plastic container as claimed in claim 1, wherein the stepped portion is spaced apart from the main body.

24. The plastic container as claimed in claim 1, wherein the stepped portion directly adjoins a transition portion of the base portion.

* * * * *